United States Patent [19]

Johnson

[11] 4,164,588

[45] Aug. 14, 1979

[54] PACKAGE LINER AND FRAGILE SNACK CHIP COMBINATION

[75] Inventor: Charles L. Johnson, Cincinnati, Ohio

[73] Assignee: The Procter & Gamble Company, Cincinnati, Ohio

[21] Appl. No.: 857,942

[22] Filed: Dec. 6, 1977

[51] Int. Cl.[2] ..... B65B 23/00

[52] U.S. Cl. ..... 426/135; 206/585; 206/594; 229/8; 229/21; 220/441; 426/124; 426/132

[58] Field of Search ..... 426/124, 128, 132, 135; 220/441, 463, 464, 470; 229/21, 4.5, 8; 206/418, 526, 583, 585, 591, 592, 594

[56] References Cited

U.S. PATENT DOCUMENTS

| | | | |
|---|---|---|---|
| 2,180,465 | 11/1939 | Gelfand | 206/585 X |
| 2,232,088 | 2/1941 | Waters | 229/21 |
| 2,300,473 | 11/1942 | Van Winkle | 206/585 X |
| 2,695,126 | 11/1954 | Russell | 220/441 X |
| 2,782,977 | 2/1957 | Thompson | 220/441 |
| 3,041,643 | 7/1962 | Struble | 229/8 |
| 3,317,118 | 5/1967 | Harrison et al. | 229/21 |
| 3,476,235 | 11/1969 | Mills | 220/441 X |
| 3,498,798 | 3/1970 | Baur et al. | 426/124 |
| 3,630,430 | 12/1971 | Struble | 229/41 B X |
| 4,011,347 | 3/1977 | Griffith | 426/124 |
| 4,020,988 | 5/1977 | Kipp | 229/21 X |

*Primary Examiner*—Steven L. Weinstein

*Attorney, Agent, or Firm*—John V. Gorman; Richard G. Witte; Thomas H. O'Flaherty

[57] ABSTRACT

A package liner adapted to protect fragile articles during shipment, handling and display in retail establishments. The liner is made of an elongated, flexible packaging material, such as a single face corrugated paper pad, having a pair of spaced, oppositely disposed, outwardly bowed lines of weakness impressed across its central width. When the ends of the liner are folded upwardly and flexed into a generally tubular conformation, the area between the lines of weakness assumes a downwardly concave shape. The resulting U-shaped structure is adapted to receive the article therewithin and cushion it against breakage when the package is dropped or exposed to lateral shock forces.

1 Claim, 8 Drawing Figures

PACKAGE LINER AND FRAGILE SNACK CHIP COMBINATION

BACKGROUND OF THE INVENTION

1. Field of the Invention

This invention relates to package liners for fragile articles and, more particularly, to a liner adapted to receive and protect a stack of uniformly shaped, non-planar chip-type snack food products.

2. Description of the Prior Art

Package liners have been used for many years to protect fragile articles from breakage during shipment, handling and display in retail establishments. An example of such a device is the corrugated sleeve disclosed in U.S. Pat. No. 3,498,798 issued on Mar. 3, 1970 to F. J. Baur et al., commonly owned by the assignee of the present invention. Other examples of protective liners are found in connection with the packaging of cookies and other fragile articles in protective sleeves for protection from damage and/or for providing body to the package as an aid for packing and handling.

SUMMARY OF THE INVENTION

In accordance with the present invention there is provided a package liner comprising an elongated sheet of flexible packaging material. The liner has a pair of spaced, oppositely disposed, centrally located, outwardly bowed, lines of weakness impressed therein and extending across its width. The lines of weakness divide the liner into a central support portion intermediate two end portions. The liner is formed into a U-shaped, generally tubular conformation with the end portions folded upwardly. The support portion of the formed liner is bowed downwardly concave.

BRIEF DESCRIPTION OF THE DRAWINGS

While the specification concludes with claims particularly pointing out and distinctly claiming the subject matter regarded as forming the present invention, it is believed the invention will be better understood from the following description taken in connection with the accompanying drawings in which:

DESCRIPTION OF THE PREFERRED EMBODIMENT

Figure 1:
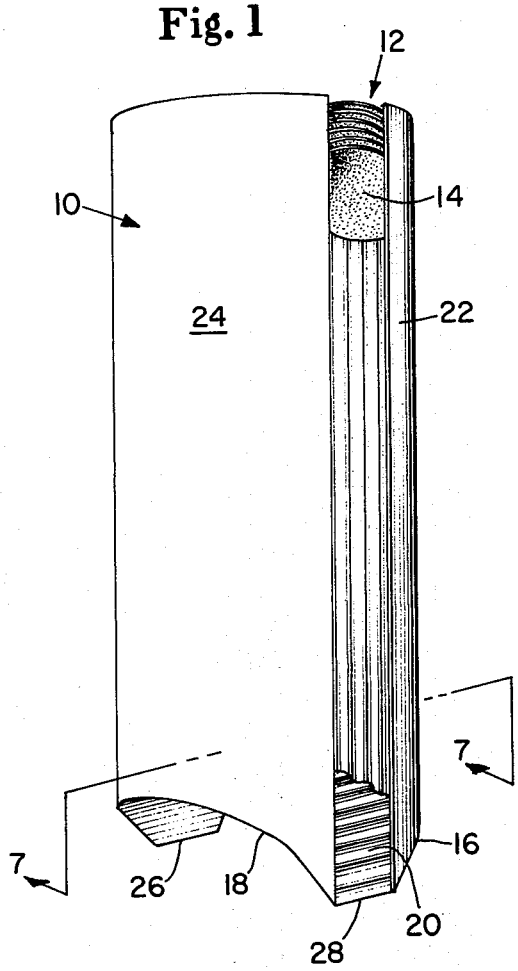
FIG. 1 is a fragmentary perspective view of a formed and filled liner of the present invention containing a stack of snack food chips, all but the upper part of the stack being broken away to show interior details of the liner.
Figure 2:
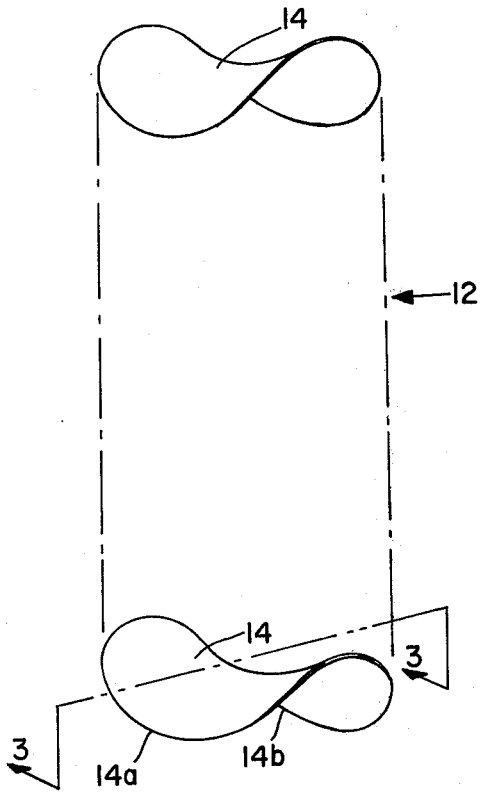
FIG. 2 is a perspective view of a stack of nestable, saddle shaped snack food chips.
Figure 3:
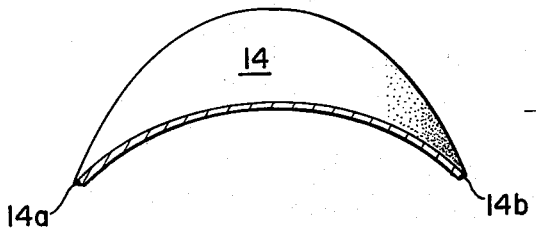
FIG. 3 is an enlarged transverse cross sectional view of the bottom chip of the stack of FIG. 2, taken along line 3—3.

Referring to FIG. 1, there is shown a package liner 10 of the present invention formed into its desired shape and filled with a stack 12 of frangible, nestable, saddle-shaped, uniformly shaped and sized, chip-type snack food products, each of the same being hereinafter referred to as chip 14. This type of chip 14 is described with particularity in the above-cited Bauer et al. U.S. Pat. No. 3,498,798, the disclosure of which is hereby incorporated by reference. Briefly stated, however, and with reference to FIGS. 2 and 3, chips 14 are curved in both longitudinal and transverse planes. In the orientation shown, the transverse curvature is downwardly concave whereas the longitudinal curvature is upwardly concave. Because of the stack 12 orientation the lower chip 14 of the stack 12 has support points **14*a*, 14*b* at opposite sides of its transverse or minor axis. The entire weight of the stack 12 is carried by such support points 14*a*, 14*b***.

Figure 7:
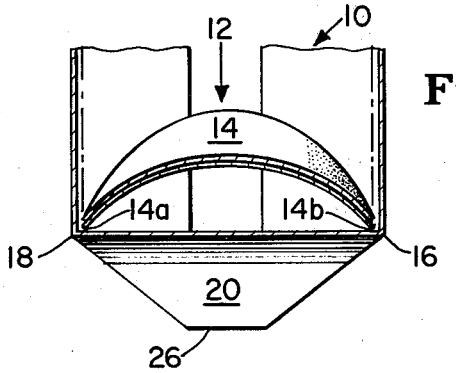
FIG. 7 is a fragmentary vertical cross sectional view taken along the line 7—7 of FIG. 1.

This type of chip 14 provides the nested stack 12 with a resistance to transversely applied loads and, hence, the stack 12 tends to maintain its integrity and shape very well in a package. While the illustrated shape of chip 14 is well adapted to be packed within the liner 10, other non-planar shapes of chips, such as that illustrated in FIGS. 7 and 8 of the aforesaid Baur et al. patent , or even flat or otherwise shaped fragile objects can also be packed in, and therefore benefit by the use of, the protective package liner of the present invention.

Figure 4:
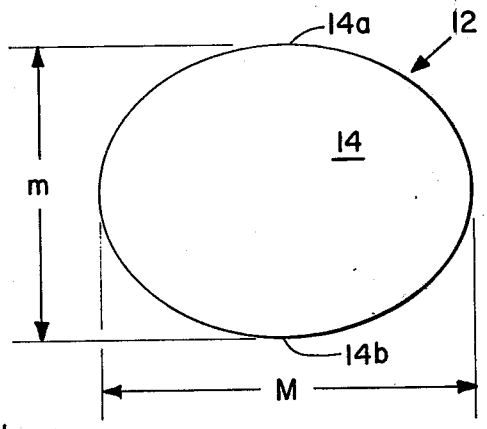
FIG. 4 is a bottom view of the stack of FIG. 2.

As shown in FIG. 4, the bottom view of the stack 12 is generally eliptical, having a major axis of length M and a minor axis of length m. For potato chips 14 of the illustrated shape, M can conveniently be about $2\frac{1}{2}''$ and m can be about $1\frac{7}{8}''$. While such sizes are not critical, they serve to provide a basis for understanding the size interrelationship with respect to the liner and, more particularly, with respect to the central region thereof, which will be discussed more fully hereinafter.

Figure 5:
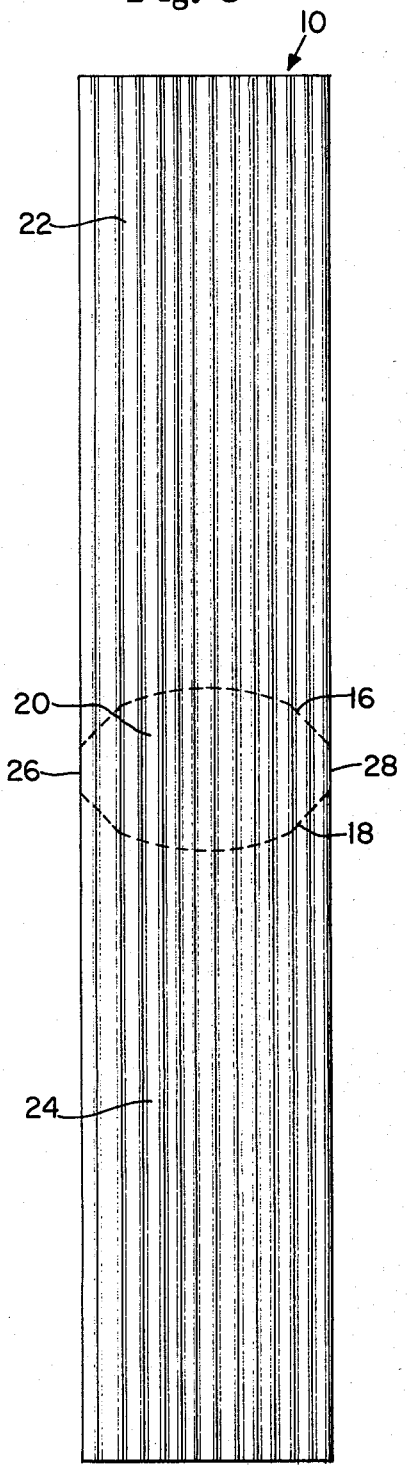
FIG. 5 is a plan view of the liner of the present invention, prior to forming.

Referring to FIG. 5, the package liner 10 is constructed of an elongated generally rectangular sheet of packaging material having physical properties sufficient to permit the material to be manipulated in the manner to be described. These properties may be varied over a wide range depending on the final dimensions of the liner 10 desired, the type and physical parameters of the lines of weakness to be impressed therein, the manner in which the liner 10 is to be formed, etc. Generally speaking, however, packaging materials will suffice so long as they have a stiffness which is at least equivalent to that of common cartonboard of a thickness of about 0.016" and sufficient flexibility to permit the material to be readily bent into the desired formed tubular shape without damage.

As shown in FIGS. 1, 5, 7 and 8 the liner is a sheet of single faced corrugated paper. The corrugations extend longitudinally to provide considerable stiffness lengthwise and flexibility widthwise, which are properties well-suited for use in connection with the subject invention. Such materials are obtainable from Malanco Inc., Blue Island, Ill., which identifies the same as WS 35/PKW 202 "B" flute. In such a material the backing sheet is 35# white sulfite paper and the corrugated sheet is 25# white sulfite paper having "B" size flutes. Either or both of the sheets can be treated for grease resistance for food use in a manner well known to those skilled in the art. Such treatment can be done with fluorocarbons or other material for providing the desired grease resistant properties for packaging chip-type snacks such as those illustrated.

In connection with potato chips 14 of the illustrated shape provided in a stack 12 which is 7½ inches high, the chips 14 being sized as described previously in connection with FIG. 4, the liner 10 material can be 3¼" wide by 17⅛" long. It will be noted that the width of the sheet is obviously less than one-half the circumference of the stack 14 and that if the sheet is to cover two sides of the stack 14, this leaves slightly over 2" of sheet to cross the bottom of the stack.

The liner 10 is provided with a pair of spaced, oppositely disposed, centrally located, outwardly bowed, lines of weakness 16, 18 impressed therein from the corrugated sheet side. The lines of weakness 16, 18 extend across the full width of the liner 10. When made of the single face corrugated paper material described, such lines of weakness preferably can comprise cut scores made with a 10 tooth per inch perforating score. Where perforations are used they should be sufficient in number and adjacency to form the line of weakness without risk of preliminary failure of the sheet during its later forming procedure, as will be understood from subsequent description. Alternatively, the line of weakness can be formed by simply scoring the liner 10 material using a scoring rule, preferably from the corrugated sheet side. For example, a scoring rule the size of that which would be used in scoring 16 point cartonboard (0.016" thick) can be used for this purpose. From the standpoint of manufacturing the liner 10, scoring is preferred.

The lines of weakness 16, 18 define therebetween a support surface 20 of a generally eliptical shape slightly larger than the dimensions of the stack 12 described in connection with FIG. 4. End portions 22, 24 are interconnected with support surface 20 along the lines of weakness 16, 18, respectively.

Figure 6:
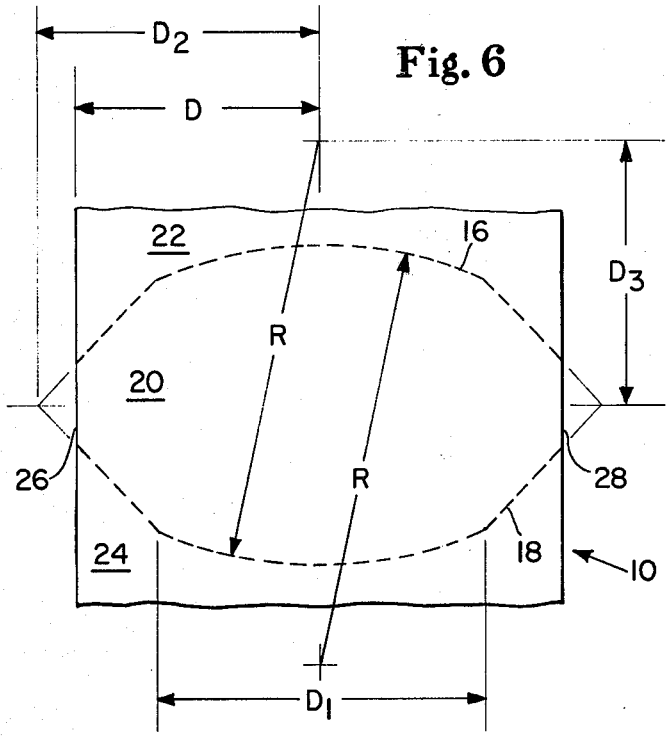
FIG. 6 is an enlarged, fragmentary view of the central portion of said liner with corrugations omitted for clarity, illustrating the dimensional parameters of the lines of weakness formed in the liner of the present invention for a chip type snack food of given size.

The preferred arrangement of the lines of weakness 16, 18 is shown in FIG. 6, where for the described liner and the dimensions of the stack 12 of potato chips 14 already set forth, the indicated dimensions to define the shape of the lines of weakness 16, 18 are as follows:

$D = 1\frac{5}{8}''$ (one half the width of liner 10)
$D_1 = 2\ 3/16''$
$D_2 = 1\frac{7}{8}''$
$D_3 = 1/23/32''$
$R = 2\frac{3}{4}''$ It will be noted that light construction lines are shown extending to points beyond the limits of the liner 10 at the distance of 1⅞" from the longitudinally extending central axis of the liner 10. These are an aid to laying out the preferred lines of weakness and, of course, form no part of the structure.

As shown, the lines of weakness 16, 18 each comprise a central arc having a radius of curvature of 2¾" and a length which would be subtended by a chord 2 3/16" long, and two straight ends. The radius of curvature of each arc is slightly greater than that of the corresponding portion of the periphery of the stack 12. The straight ends of the lines of weakness are designed to converge on the edges of the liner 10 at angles $\alpha$ which are more acute than those which would be the case if the central arc had been made full width of the liner 10. It is not essential that the ends be straight. For example, curved lines having the same effect (the changed angle of convergence) would also be suitable in place of the straight ends. For the liner structure described, the angles $\alpha$ should be about 45°.

When so constructed and when the liner 10 is folded as indicated hereinafter, the flat sides 26, 28 of support surface 20 tuck inwardly, within the confines of the cylindrical configuration of the formed liner 10. This would not be the case if the arcs were made full width. While this may be of no consequence in relation to some uses for the protective liner 10, it is significant if the item is to be handled and applied by automated equipment. In such case any outwardly projecting portions of the formed liner 10 could very well cause numerous problems. For example, if the liner 10 is to be loaded with the stack 12 automatically and enclosed within a pouch in a vertical form, fill and seal machine, it is apparent that hang-up of the liner in the filling mandrel or tube because of projections could cause serious problems. (Such machines are generally described in U.S. Pat. No. 2,145,941 which issued to D. E. Maxfield on Feb. 7, 1939.) This difference is also significant from the standpoint of providing a formed support surface which is more deeply dished than would be the case if the arc portions had been extended full width and, thus, is believed to be capable of providing greater shock absorbing properties.

The liner 10 described is formed by folding end portions 22, 24 upwardly, out of the plane of support portion 20, while flexing them transversely into curved surfaces similar in cross section to the curvature of the adjacent line of weakness 16 or 18. This produces a tubular conformation of the liner 10 as shown in FIG. 1. It has a support surface which is bowed widthwise of the liner into the downwardly concave condition illustrated in FIGS. 1 and 7. The formation can be done by hand or machine, but in any event the formed liner 10 is loaded with the stack of 12 of chips 14.

Figure 8:
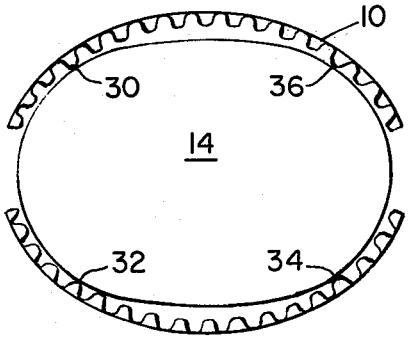
FIG. 8 is a plan view of the formed and filled liner of FIG. 1.

The support points **14*a*, 14*b* bear on the support surface 20 at locations closely adjacent the lines of weakness 16, 18 at their centers. As shown in FIG. 8, the liner 10 contacts the periphery of stack 12 of chips 14 at four locations 30, 32, 34, 36, which are thought to correspond with the ends of the straightest sections which can be taken through the chips 14 along intersecting diagonal planes. This belief is based on the theory that the columnar strength will be greater across such planes than across others. It is believed that this protects the chips 14 against breakage because of the fact that lateral contact and impact is made principally at locations 30, 32, 34, 36**.

In use, the loaded package liner 10 can be placed in a can, a bag, a pouch or any other enveloping package which is appropriate to the type of article packaged therein. In the case of chip-type food products such as the potato chips 14 described above, it would be most appropriate to place the loaded package liner 10 in a pouch constructed of a foil laminate.

Because of the package liner 10, the stack 12 is cushioned from damage caused by dropping or by laterally directed impact forces, the latter having been discussed hereinabove. Upon dropping, for example, the momentum of the stack 12 can cause the support points **14*a*, 14*b* to exert sufficient force on the central parts of the lines of weakness to fracture them. The fracturing and any subsequent dislocation of the support surface 20 in effect absorbs energy which would otherwise have damaged the stack. In addition, the depending portions of the support surface 20**, i.e. those terminating in flat sides 26, 28, are springy and tend to absorb shock loads, minimizing damage to the stack 12.

While a particular preferred embodiment of the present invention has been illustrated and described, it will be obvious to those skilled in the art that various changes and modifications can be made without departing from the spirit and scope of the invention. It is intended to cover in the appended claims all such changes and modifications that are within the scope of this invention.

I claim:

1. A liner for a package said liner containing a stack of uniformly sized and shaped, fragile, generally eliptical, non-planar, snack food chips, the chips having a lower surface which is transversely concave as viewed along its major axis, said stack being arranged with corresponding surfaces of the chips similarly oriented and having the transversely concave surfaces thereof facing downwardly to thereby provide a stack support point at each end of the minor axis of the lowermost chip, said liner being formed from an elongated, generally rectangular sheet of material the width of which is less than one half the periphery of the stack as measured along a plane at right angles to the axis of the stack, said sheet having longitudinally extending corrugations to provide stiffness lengthwise and flexibility widthwise, said sheet having a pair of oppositely disposed, centrally located, outwardly bowed, lines of weakness impressed therein and extending across its width, said lines of weakness defining therebetween a support surface of a generally eliptical shape slightly larger than said chips, said support surface being bowed widthwise of the sheet into a downwardly concave condition and the portions of the sheet on each side of the support surface being folded upwardly and formed into a U-shaped, generally tubular conformation receiving the stack, with the support points on the lowermost chip bearing on said support surface at locations closely adjacent the lines of weakness at the central portions thereof such that upon dropping, the momentum of the stack can cause the support points to exert sufficient force on the central portions of the lines of weakness to fracture them, thus absorbing energy which would otherwise damage the stack.

* * * * *